United States Patent [19]

Dufour

[11] Patent Number: 4,856,562

[45] Date of Patent: Aug. 15, 1989

[54] PAPERMAKERS WET FELTS

[75] Inventor: Marcel Dufour, Sryrieix, France

[73] Assignee: Asten Group, Inc., Charleston, S.C.

[21] Appl. No.: 357,014

[22] Filed: Mar. 11, 1982

[30] Foreign Application Priority Data

Mar. 11, 1981 [FR] France ..... 81 04839

[51] Int. Cl.[4] ..... D03D 15/00; D21F 7/08; D21F 1/00; B32B 5/02

[52] U.S. Cl. ..... 139/383 A; 139/420 R; 139/425 A; 428/234; 428/253; 162/DIG. 1; 162/358

[58] Field of Search ..... 139/383 A, 425 A, 420 R, 139/420 A, 426; 66/169, 170, 195, 190, 87.94; 428/234, 235, 253, 257-259; 162/DIG. 1, 348, 358, 359; 34/95.116, 123, 243

[56] References Cited

U.S. PATENT DOCUMENTS

| | | | |
|---|---|---|---|
| 2,006,275 | 6/1935 | Meiwald | 66/169 R |
| 2,064,074 | 12/1936 | McNamee | 139/420 R |
| 2,968,085 | 1/1961 | Matthews . | |
| 3,158,984 | 12/1964 | Butler | 139/383 A |
| 3,728,876 | 4/1973 | Richard et al. . | |
| 3,948,722 | 4/1976 | Wheeldon et al. . | |
| 4,007,611 | 2/1977 | Blezard | 66/169 R |
| 4,290,209 | 9/1981 | Buchanan et al. | 139/383 A |
| 4,356,225 | 10/1982 | Dufour | 428/234 |
| 4,361,618 | 11/1982 | Dufour et al. | 428/234 |

FOREIGN PATENT DOCUMENTS

| | | | |
|---|---|---|---|
| 652873 | 11/1937 | Fed. Rep. of Germany | 66/169 |
| 790861 | 9/1980 | Finland . | |
| 539899 | 4/1922 | France . | |
| 1109424 | 9/1955 | France . | |
| 1557944 | 1/1969 | France . | |
| 219139 | 7/1924 | United Kingdom | 139/420 R |
| 1220531 | 1/1971 | United Kingdom | 139/383 A |

OTHER PUBLICATIONS

*Albany Felt Fabric and Facts,* Jul./Aug. 1977, Albany Felt Company, Albany, N.Y. 12201, Received in Group 170, Mar. 11, 1982.

*Primary Examiner*—James Kee Chi

*Attorney, Agent, or Firm*—Volpe and Koenig

[57] ABSTRACT

Papermaker's felt employing compressible knit yarn in a woven base to provide a durable resiliency so as to provide vibration dampening and delay the occurrence of crushing during papermaking.

28 Claims, 2 Drawing Sheets

PAPERMAKERS WET FELTS

This application claims priority from French patent application registration No. 8104839, filed Mar. 11, 1981.

The present invention relates to felts or paper machine clothing which are used for conveyor belts and filtration belts on papermaking machines.

Papermaking machines which continuously process paper into pulp have three sections:

- a first section for the formation of an aqueous sheet by water filtration,
- a second section for the dewatering of the wet sheet by water extraction, and
- a third section for the drying of the sheet by airsteam filtration.

At each stage of this process, conveyor belts or similar items are utilized to form, press, and dry. These belts are conventionally made from felts or paper machine clothing which may be comprised of a woven base with a batt needled on one or both faces.

The main functions of the felt belts are to transport the wet paper sheet, to allow water removal by running the sheet between appropriate devises and then, after water is mostly removed, to run the sheet on heated cylinders to facilitate its drying. Drying is done by increasing the cylinder heat transfer towards the sheet and by creating a spontaneous ventilation to facilitate evaporation and absorption of a certain quantity of water content.

During the dewatering phase, the wet paper, supported on the wet felt belt, is squeezed as it passes through the nip of the machine to facilitate water removal therefrom. In time, the felt becomes matted and its thickness decreases as it is continuously passed through the nip. Generally, when the felts are not damaged, there exists a theoretical thickness limit EL at the machine nip below which the wet end paper clothing cannot function. If this EL thickness limit is surpassed some crushed areas appear in the felt which will be indicated hereafter by "crushing". The EL thickness limit is the result of three factors:

- eF theoretical felt thickness reduced to a homogeneous unit, (i.e., no free void volume)
- ee thickness corresponding to the quantity of water carried by the felt,
- ef corresponding to the thickness of the paper sheet with water content.

Accordingly, $EL = eF + ee + ef$.

Not only does papermaking become problematic because of the occurrence of crushing, but it was found that the machine rolls and cylinders were submitted to vibrations harmful to the quality of the sheet obtained as the thickness in the nip approaches the limit EL.

It is an object of the present invention to provide a felt for papermachine clothing comprised of a permeable fabric having warp yarns interlaced with weft yarns, some of which are knitted compressible yarns, in order to give to the felt additional cushioning to dampen vibrations between the rolls and cylinders of the paper machine and delay the occurrence of crushings.

Other objects and advantages of the present invention will become apparent from the following portion of the of the specification and from the accompanying drawings which illustrate, in accordance with the mandate of the patent statutes, a presently preferred embodiment incorporating the principals of the invention.

Figure 1:
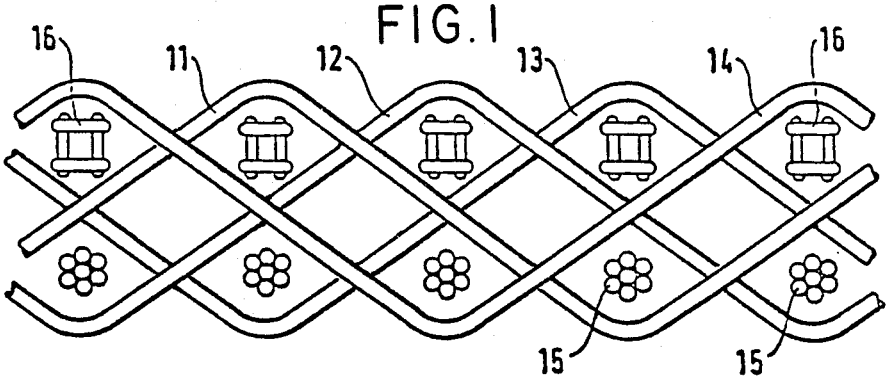
FIG. 1 is a CMD section view of a base woven with two warps in accordance with the teachings of the present invention.

FIG. 1 represents a water permeable fabric made of weft yarns 11, 12, 13, 14 and two layers of warp 15, 16. The weft yarns are monofilament yarns. The warp yarn layer 15 is comprised of incompressible cabled yarns. The yarn 16 of the other warp layer is comprised of knitted compressible cabled yarns, for instance yarns with stitches as shown in FIG. 3.

Figure 2:
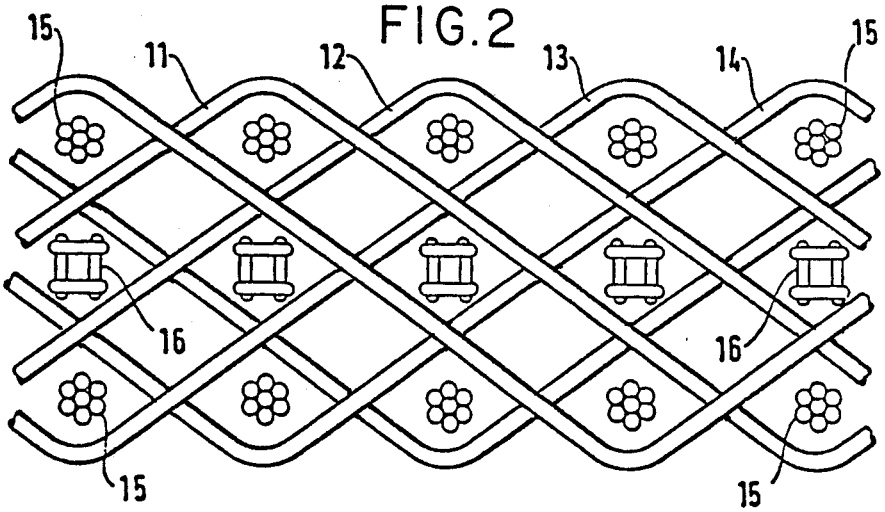
FIG. 2 is a CMD section view of a base woven with 3 warps.

FIG. 2 represents a variation of fabric comprised of monofilaments weft yarns 11, 12, 13, 14 and 3 layers of warp yarns 15, 16. The two layers of warp yarn 15 are comprised of noncompressible cables yarns. The warp yarn 16 of the middle layer is comprised of compressible knitted cabled yarns. The compressible layer 15 is thus inserted between two noncompressible layers 15.

The noncompressible layers provide longitudinal strength. The use of compressible yarns in the felt gives it a certain resiliency and shock absorption effect, moreover preserving its resistance to wear, its permeability and its absorption quality.

Figure 3:
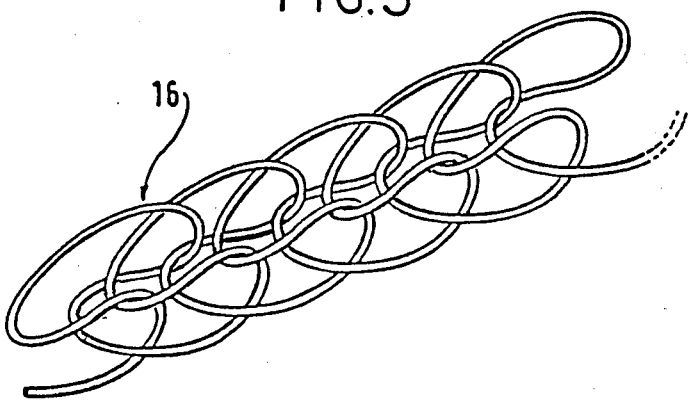
FIG. 3 is an enlarged perspective view of a compressible knitted yarn.

In the preferred embodiment, the weft and warp yarns are made of synthetic fibers and the compressible knitted yarn is formed of a monofilament to better preserve its shape and knitted in such a manner as to constitute a basic string of compressible elements (FIG. 3). Alternatively, the compressible yarn can be comprised of a supporting core and one or many knitted yarns coiled up around the supporting core. Also, the knitted yarns may be made from synthetic or metallic multifilments.

It is desirous to incorporate the knitted yarns into the fabric without constricting its volume. Preferably knitted yarns longer than the felt are utilized in the weave; this allows the yarn to work without tension and the knitted yarn stitches to keep their shape for the purpose of obtaining maximum shock absorption. Also, the knitted yarn can be chemically treated before weaving, such as being coated with resin, to increase its resistance to unraveling.

Figure 4:
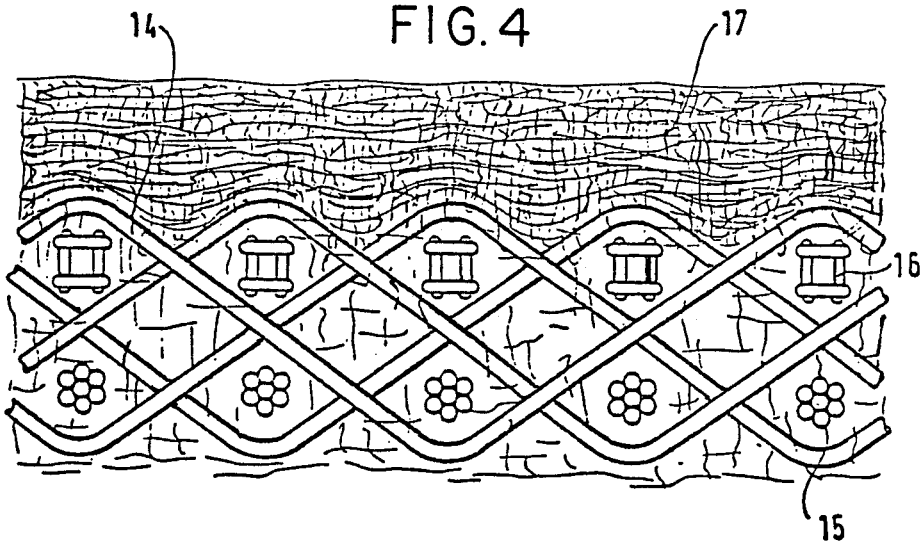
FIG. 4 is a sectional view of the base fabric of FIG. 1 overlaid with a needled fiber batt.
Figure 5:
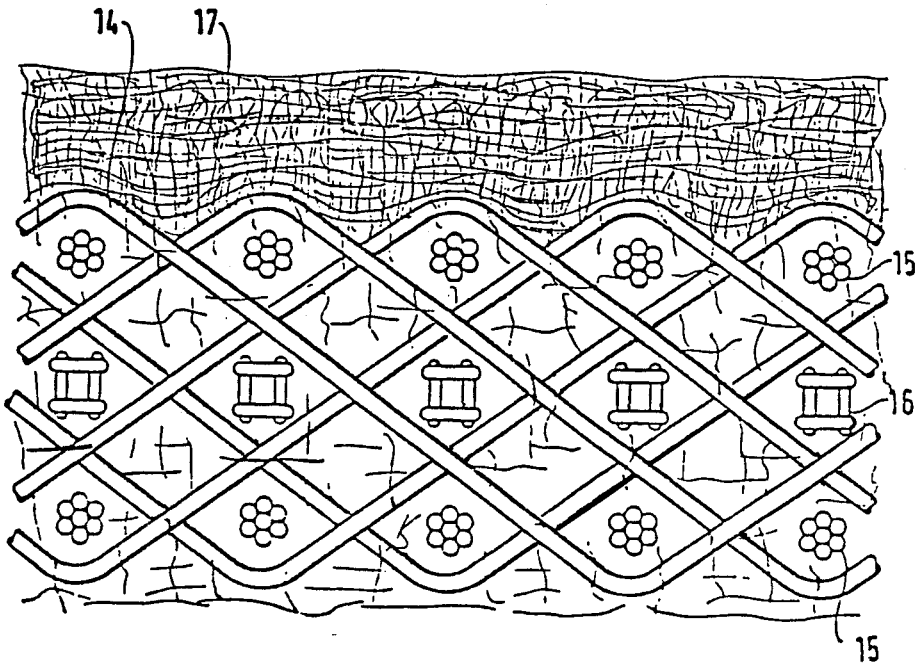
FIG. 5 is a sectional view of the base of FIG. 2 overlaid with a fiber batt.

As shown in FIGS. 4 and 5, a batt of fiber 17 is anchored to the respective bases by a conventional needling technique to give the felt a smooth and nonmarking surface to avoid the risk of paper marking. The fibers of batt 17 are anchored partly in the base fabric and form a batt of 4 to 5 mm on top of the base.

Felt incorporating the teachings of the present invention may be used in all three stages of papermaking as follows:

1. Forming fabrics for the Fourdrinier wire section,
2. Wet felts for the press section, and
3. Dryer felts for dryer sections.

Such felts are particularly advantageous when used on the wet end, since felts having compressible knitted yarns have the following advantages for papermaking:

1. Elimination or postponement of crushing. Felt, i.e. the point at which the felt is compacted and has reached the minimum thickness permitted for its functioning;

2. Maximum water handling; and
3. Shock absorption for diminishing or suppressing vibrations.

Knitted or cabled yarn of square section or the like present a certain rigidity. Paper machine felts employing knitted yarns yield a more compressible felt which can act as shock absorption between the rolls of the paper machine. The utilization of felts weaved with knitted yarns in a permanent or progressive incompressible structure bring about a permanent difference in the thickness of the free base fabric and the compressed base fabric (i.e., when in the machine nip). This thickness will vary in accordance with the position considered in the wet section and will be greater for the first position, less for the last positions. The thickness difference may be varied in accordance to the dryness desired for the sheet.

The resiliency obtained from the utilization of cabled or knitted yarn assures a good sheet handling, sufficient for good dryness and good life.

The compressible yarns may be introduced in the felts as either warp or weft yarns. In fact, in the example given one could replace the noncompressible warp yarn by compressible cabled yarns for the purpose of easier fabrication. However, one could also utilize compressible yarns for the weft yarns or even insert compressible yarns both in the warp and the weft yarns. Also, one could utilize only knitted yarns both in the warp and weft yarns.

What is claimed is:

1. Papermarker's felt composed of a permeable fabric having interwoven warp yarns with weft yarns, characterized by the fact that at least certain of these yarns are made of compressible knitted yarns so as to give to the felt shock absorption effect to vibrations between rolls and cylinders of the papermachine and to postpone crushing.

2. Felt according to claim 1, having at least one layer of warp yarns of knitted and compressible yarns.

3. Felt according to claim 2, characterized by the fact that knitted compressible yarns are introduced in between multiple layers of warp yarns.

4. Felt according to claim 3, characterized by the fact that the compressible yarns are longer than the felt in which it is interwoven and thus can work without tension allowing the stitches of said compressible knitted yarn to keep their shape.

5. Felt according to claim 1 characterized by the fact that the knitted yarn has a center thread entwined with one or many knitted yarns.

6. Felt according to claim 1 characterized by the fact that the knitted yarn is comprised of a single yarn such as a monofilament, which stitches are not stretched.

7. Papermaker's felt made of a permeable fabric having a woven base of warp and weft yarns, comprising:

means for providing a durable resiliency and enhancing absorbency in said base including at least one layer of warp yarns comprising a compressible knitted yarn.

8. Papermaker's felt according to claim 7 wherein:

incompressible cable yarns comprise a second layer of warp yarns for providing longitudinal strength and preventing the stretching of said knitted yarn.

9. A papermaker's felt according to claim 7 further comprising:

a batt needled to at least one face of said base.

10. A papermaker's felt according to claim 8 further comprising:

a batt needled to at least one face of said base.

11. An improved papermaker's felt comprising at least two systems of yarns interwoven to produce a woven base fabric characterized by having knitted yarns in at least one of the yarns systems for enhancing the absorbency and resiliency of said base fabric and thereby increasing the felt's dewatering capacity and useful life as a papermaker's felt.

12. A papermaker's felt according to claim 11 wherein:

said knitted yarns comprise a system of warp yarns.

13. A papermaker's felt according to claim 12 further comprising:

a batt needled to at least one face of said base fabric.

14. A papermaker's felt according to claim 11 wherein:

said knitted yarns comprise a system of weft yarns.

15. A papermaker's felt according to claim 14 further comprising:

a batt needled to at least one face of said base fabric.

16. A woven papermakers felt comprised of interwoven warp and weft monofilament yarns, characterized by:

having at least selected yarns among said interwoven yarns being compressible knitted yarns.

17. The fabric of claim 16 wherein, said warp and weft yarns define at least three yarn systems with one of said systems being comprised solely of compressible knitted yarns.

18. The fabric of claim 17 wherein said fabric further comprises a batt needled thereto.

19. The fabric of claim 16 wherein, said warp and weft yarns define at least two yarn systems with one of said yarn systems being comprised solely of compressible knitted yarns.

20. The fabric of claim 19 wherein, said fabric further comprises a batt needled thereto.

21. A woven papermakers fabric comprised of at least two systems of yarns, characterized by:

having at least one system of compressible knitted yarns interwoven with at least one system of longitudinally extending incompressible monofilament yarns with said compressible knitted yarns retaining substantially all of their initial yarn volume.

22. The fabric of claim 21 wherein, said fabric further comprises:

at least three systems of yarns with said knitted compressible yarns being non-parallel with respect to said incompressible yarn systems.

23. The fabric of claim 21 wherein, said fabric further comprises:

at least three systems of yarns with said incompressible yarns and said compressible knitted yarns extend in the same direction and generally parallel with respect to each other.

24. The fabric of claim 21 wherein said fabric further comprises a batt needled thereto.

25. A papermakers felt having a permeable woven base fabric of warp and weft yarns, characterized by:

substantially incompressible monofilament weft yarns being interwoven with at least one layer of compressible knitted warp yarns.

26. The felt of claim 25 wherein said felt further comprises a batt needled thereto.

27. A papermakers felt having a permeable woven base fabric of warp and weft yarns characterized by:

substantially incompressible monofilament warp yarns interwoven with substantially compressible knitted weft yarns which retain substantially all of their initial knitted yarn volume.

28. The fabric of claim 27 wherein said fabric further comprises a batt needled thereto.

* * * * *

UNITED STATES PATENT AND TRADEMARK OFFICE

CERTIFICATE OF CORRECTION

PATENT NO. : 4,856,562

DATED : August 15, 1989

INVENTOR(S) : Marcel Dufour

It is certified that error appears in the above-identified patent and that said Letters Patent is hereby corrected as shown below:

At column 2, line 65, after the word "crushing" and before the ",", delete --. Felt--.

At column 3, line 15, delete the word "position" and insert therefor --positions--.

Signed and Sealed this

Seventeenth Day of July, 1990

*Attest:*

*Attesting Officer*

HARRY F. MANBECK, JR.

*Commissioner of Patents and Trademarks*